United States Patent [19]

Fong et al.

[11] Patent Number: 4,826,129

[45] Date of Patent: May 2, 1989

[54] STRUCTURE OF FAUCET FOR AUTOMATIC WATER SUPPLY AND STOPPAGE

[75] Inventors: Jach Fong; Jack Chen, both of Kaohsiung, Taiwan

[73] Assignee: Caprilion Enterprise Company, Kaohsiung, Taiwan

[21] Appl. No.: 189,800

[22] Filed: May 3, 1988

[51] Int. Cl.[4] ..... F16K 31/06

[52] U.S. Cl. ..... 251/129.04; 251/65; 251/129.1; 4/623

[58] Field of Search ..... 251/129.04, 129.1, 65; 4/623

[56] References Cited

U.S. PATENT DOCUMENTS 3,333,160 7/1967 Gorski ..... 251/129.04

4,682,628 7/1987 Hill ..... 251/129.04 X

*Primary Examiner*—Arnold Rosenthal

*Attorney, Agent, or Firm*—Holman & Stern

[57] ABSTRACT

The present invention relates to an improved faucet structure for automatic water supply and stoppage wherein the controller actuates the two-way electromagnetic valve to let the water flow out when the user's hands are close to the front of said faucet, and the valve is capable of automatic locking and can be actuated by only an instantaneous trigger of electric energy so as to achieve the practical purpose of saving power, safety and convenience.

14 Claims, 3 Drawing Sheets

STRUCTURE OF FAUCET FOR AUTOMATIC WATER SUPPLY AND STOPPAGE

BACKGROUND OF THE INVENTION

Since the rapid development of business entails the people's relative living level, the neat home surroundings and personal health in general and the health in public places in particular are gradually subject to our emphasis. In order to avoid the phenomenon of repeated pollution from happening, nowadays it is considerably popular to equip the public bathroom and latrine with the automatic faucet. However, the power source at present of most automatic faucets is a.c., so after they are started for use, it is in need of steady power supply to the coil in the electromagnetic valve in order to keep the mandrel in the exact position. Therefore, the conventional automatic faucet not only wastes energy but also will cause electric leakage to hurt the people and cannot be serviceable when power failure occurs.

The present inventor, in order to eliminate the foregoing drawbacks, through his wholehearted research for many years, has developed an improved structure of faucet for automatic water supply and stoppage.

SUMMARY OF THE INVENTION

The primary object of the present invention is to offer an improved faucet structure for automatic water supply and stoppage wherein the two-way electromagnetic valve is capable of automatic locking, namely, when someone's hand is close to the front of an infrared transmitter and receiver of the control, the clockwise coil which is in the two-way electromagnetic valve receives the electric energy at once to attract the mandrel upward to be held in the exact position by a permanent magnet, so that the close block ooens the water passage to let the water flow and at the same time, the clockwise coil loses the electric energy and needs no power supply until the hand moves away from the front of infrared transmitter and receiver at which time, the control puts out an instantaneous electric energy to the counterclockwise coil which receives the electric energy to attract the mandrel downward so that the mandrel returns to its original position through the spring around the mandrel, restoring its elastic force, and the close block closes the water passage so as to stop the water flowing out. Therefore, when using the present invention, only instantaneous trigger electric energy is needed in order to achieve the purpose and practicability of saving power.

Another object of the present invention is to offer an improved structure of faucet for automatic water supply and stoppage wherein a battery is used as a power source so as to eliminate the drawback of hurting the people because of electric leakage and consequental inoperativeness because of power failure, and to provide practicability with safety.

The present invention relates to an improved structure of faucet for automatic water supply and stoppage wherein the two-way electromagnetic valve is under the control of a controller, so that when somebody is close to the front of an infrared transmitter and receiver of said controller, the clockwise coil of said valve is actuated to let the mandrel move upward, then the water will flow out through the inlet and outlet passages; since the valve is capable of automatic locking, it can be actuated by an instantaneous trigger of electric energy, and its power source is a battery, so it can achieve the practical purpose of saving power, safety and convenience.

DRAWINGS

DETAILED DESCRIPTION OF THE PREFERRED EMBODIMENT

Figure 1:
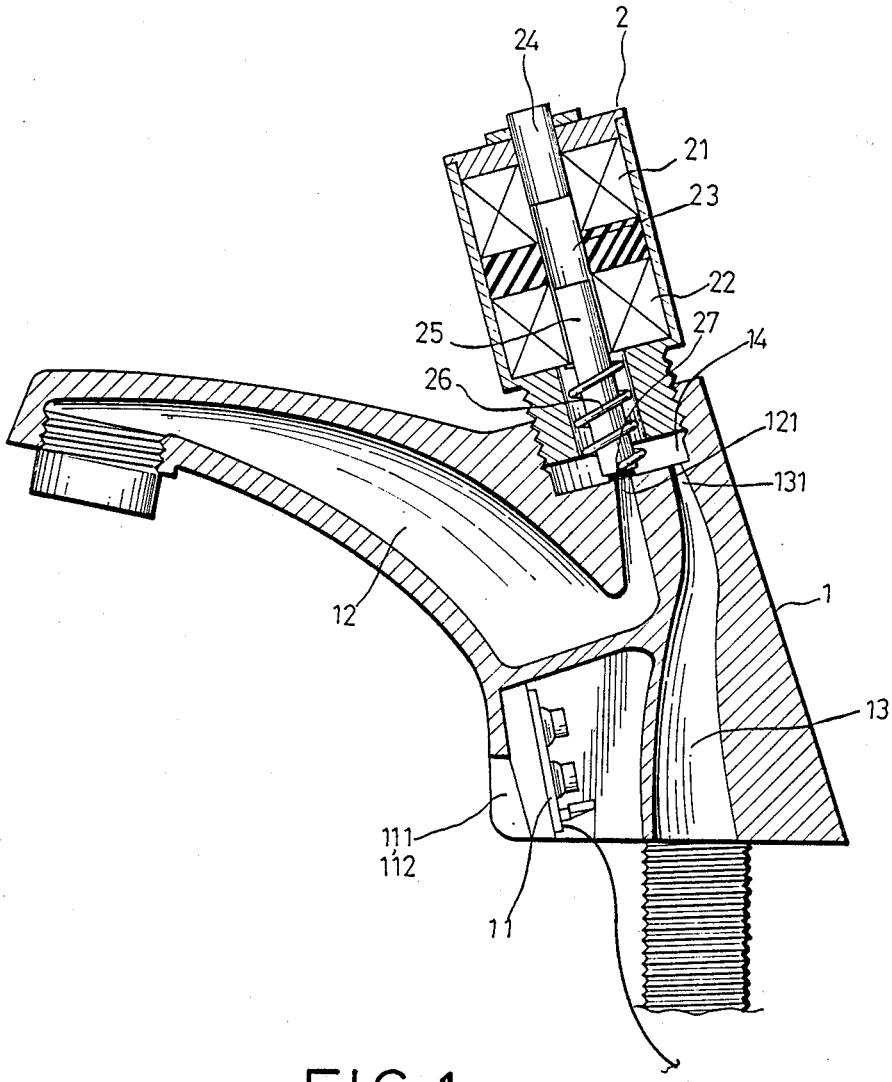
FIG. 1 is a section view of the structure of the present invention.

As shown in FIG. 1, a controller(11) is deposed at the inner bottom of faucet(1), the infrared transmitter(111) and infrared receiver(112) of said controller(11) are toward the front, an outlet passage(12) and an inlet passage(13) are disposed in the faucet(1), the openings of cross passages(121) (131) are in the bottom surface of said recess(14), a two-way electromagnetic valve(2) is installed in the recess(14), a clockwise coil(21) and a counterclockwise coil(22) are installed in the two-way electromagnetic valve(2), a permanent magnet(24) is fixed in the upper part of a shaft hole(23), a mandrel(25) is inserted in the lower part of said shaft hole(23), a close block(27) is mounted on the end of said mandrel(25) and opposite to the end A(121) of outlet passage(12) and fixed onto an end of spring(26), and another end of spring(26) is caught around the opening of said shaft hole(23).

Figure 2:
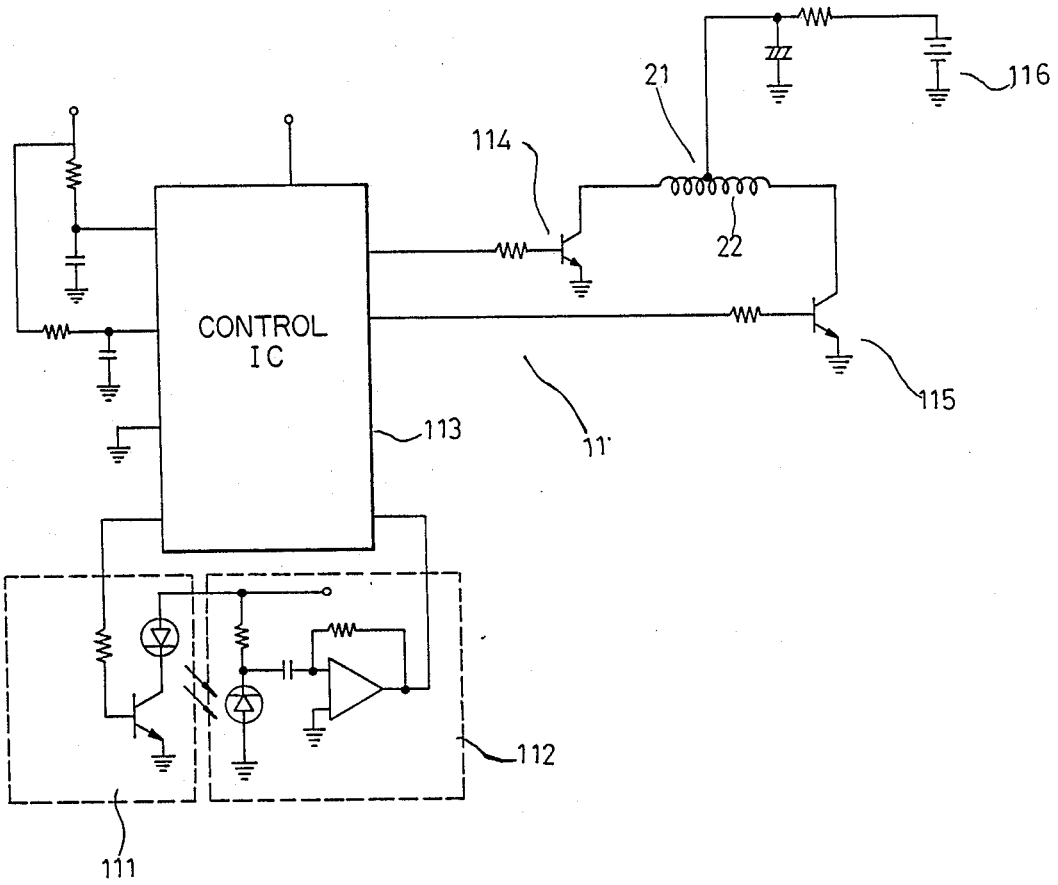
FIG. 2 is a detailed circuit diagram of controller of the present invention.
Figure 3:
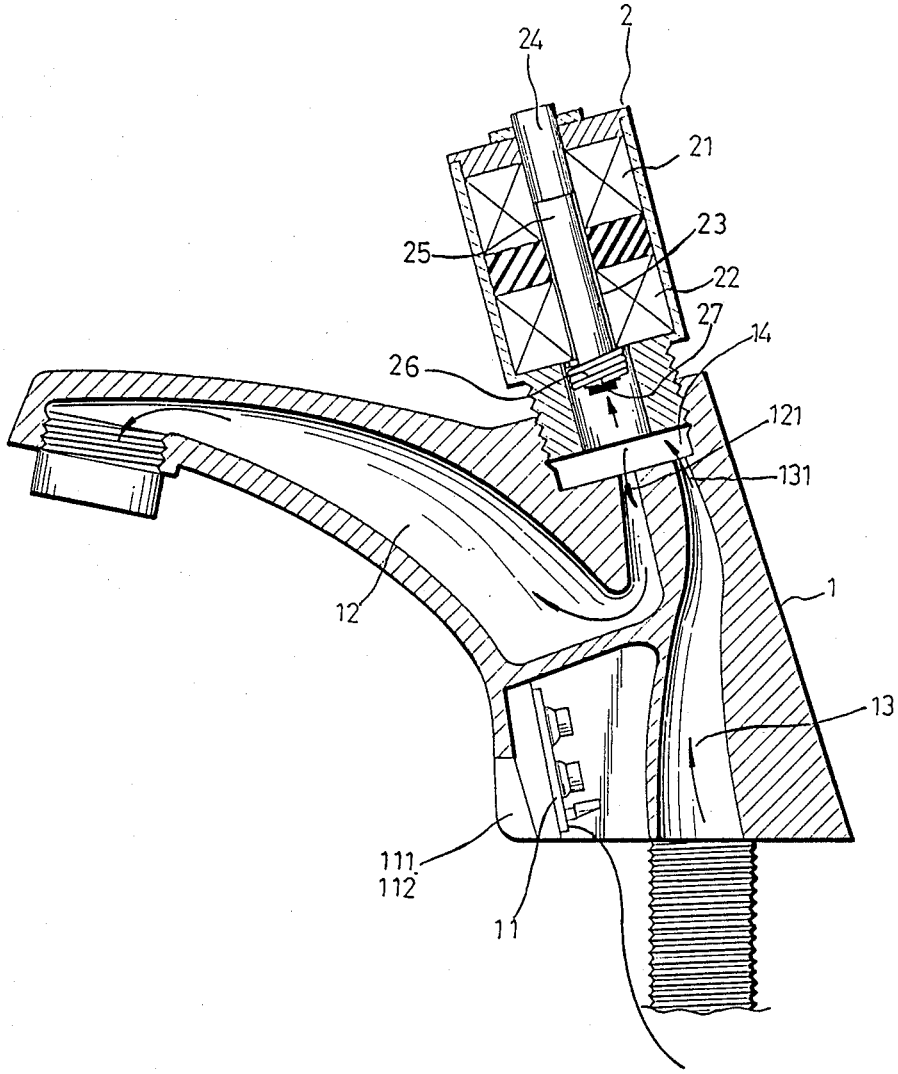
FIG. 3 is an optional view of the present invention in operation.

When using the present invention, as shown in FIG. 2 and 3, the user may put his or her hands in front of infrared transmitter(111) and infrared receiver(112) of said controller, namely, below the outlet passage(12) of faucet(1), so as to generate an induction current which can cause the control IC(113) of controller(11) to put out an instantaneous high-potential trigger signal to the clockwise actuator(115) to form a closed circuit, the current from the battery(116) flows through clockwise coil(21) of two-way electromagnetic valve(2) to let clockwise coil(21) generate magnetic force to attract the mandrel upward; and since a permanent magnet(24) is mounted in the upper part of the shaft hole(23), the mandrel(25) which moves upward is attracted and held in place by the permanent magnet(24) and needs no more magnetic force generated by the clockwise coil(21) to attract it is place; and at the same time, the spring (26) is compressed and deformed, and the close block(27) moves upward to leave from the cross(121) outlet passage(12), so the water in the water pipe can flow out through the cross passage(131) of inlet passage(13) and the recess(14) and the ends A(121) and B(122) of outlet passage(12) so as to achieve the purpose of automatic water supply. After the user finishes washing his or her hands and moves his or her hands away from the front of infrared transmitter(111) and infrared receiver(112) of said controller(11), the control IC(113) puts out an instantaneous high-potential trigger signal to the counterclockwise actuator(114) to form a closed circuit, the current from the battery(116) flows through the counterclockwise coil(22) of two-way electromagnetic valve(2) to let the counterclockwise coil(22) generate a magnetic force which is larger than that of the permanent magnet(24) and can attract the mandrel(25) downward, and at the same time, through the spring(26) restoring its elastic force, the mandrel(25) can quickly and steadily move and the close block(27) at its end which blocks the end A(121) of outlet passage(12) so as to stop the water flow and to achieve the purpose of automatic water stoppage.

We claim:

1. An improved faucet for automatic water supply and stoppage comprising a controller disposed at the inner bottom of the faucet, an infrared transmitter and infrared receiver of said controller disposed toward the front of the faucet and coupled to said controller, a water flow passage including outlet and inlet passages and cross passages connected to said outlet and inlet passages and communicating with the bottom surface of a recess, and a two-way electromagnetic valve disposed in the said recess, said valve including, a clockwise coil and a counterclockwise coil disposed in the said valve, a permanent magnet fixed in the upper part of a shaft hole extending upwardly from the recess in coaxial disposition with said coils, a mandrel inserted in the lower part of the shaft hole, a close block mounted at the end of said mandrel and just opposite to a first one of said cross passages connected to said outlet passage, a spring having one end fixed onto an end of said mandrel, and with another end of said spring being caught around the opening of said shaft hole, whereby detection of a user adjacent to said transmitter and receiver of the controller, enables the controller to actuate the two-way electromagnetic valve to provide automatic water supply and stoppage between said inlet and outlet passages via said cross passages and recess.

2. The faucet of claim 1, wherein said infrared transmitter and receiver sense the presence of a user, in proximity to the faucet to enable said controller to provide a first trigger signal, and sense removal of a user from proximity to the faucet to enable said controller to provide a second trigger signal.

3. The faucet of claim 1, wherein a first one of said clockwise and counterclockwise coils is disposed to move said mandrel and close block away from said first one of said cross passages upon reception of said first trigger signal from said controller, said parmanent magnet is disposed to hold said mandrel away from said first one of said cross passages after said mandrel is moved away from said first one of said cross passages, and a second one of said clockwise and counterclockwise coils is disposed to move said mandrel away from said permanent magnet and toward said first one of said cross passages upon reception of said second trigger signal from said controller.

4. The faucet of claim 3, wherein said spring is disposed to bias said mandrel to travel toward said first one of said cross passages.

5. The faucet of claim 1, further comprised of a constant potential source coupled to said clockwise and counterclockwise coils, and said controller is coupled to said clockwise and counterclockwise coils to selectively connect, said constant potential source via alternate ones of said clockwise and counterclockwise coils to a ground potential.

6. The faucet of claim 2, further comprised of a constant potential source coupled to said clockwise and counterclockwise coils, and switching means disposed between said coils and controller to selectively connect said constant potential source to a ground potential via alternate ones of sad clockwise and counterclockwise coils in response to reception of corresponding ones of said first and second trigger signals.

7. The faucet of claim 3, further comprised of a constant potential source coupled to said clockwise and counterclockwise coils, and switching means disposed between said coils and controller to selectively connect said constant potential source to a ground potential via alternate ones of said clockwise and counterclockwise coils in response to reception of corresponding ones of said first and second trigger signals.

8. The faucet of claim 4, further comprised of a constant potential source coupled to said clockwise and counterclockwise coils, and switching means disposed between said coils and controller to selectively connect said constant potential source to a ground potential via alternate ones of said clockwise and counterclockwise coils in response to reception of corresponding ones of said first and second trigger signals.

9. A faucet for automatic water supply and stoppage, comprising:

controller means disposed within a faucet to sense the presence and removal of a user from in proximity to the front of the faucet, for providing a first trigger signal upon sensing the presence of a user in proximity and for providing a second trigger signal upon sensing removal of the user from proximity;

electro-magnetic valve means disposed to interrupt passage of effluent between an inlet to the faucet and an outlet at the front of the faucet, said electromagnetic valve means including oppositely wound first and second coils, a shaft extending coaxially through said coils, a permanent magnet positioned to engage said mandrel while said mandrel is in an upper position, bias means for urging said mandrel toward a lower position to interrupt the flow of effluent between said inlet and outlet, said electromagnetic valve means for providing electro-magnetic force causing said mandrel to travel to said upper position in response to said first trigger signal and for providing electro-magnetic force for urging said mandrel to travel to said lower position in response to said second trigger signal; and switching means to disposed between said controller means and said electro-magnetic valve means for coupling corresponding ones of said first and second coils in an electrically conducting circuit in response to reception of respective ones of said first and second trigger signals.

10. The faucet of claim 9, further comprising:

cross passages connecting said outlet and inlet within the faucet;

said mandrel engaging a first one of said cross passages while in the lower position to interrupt flow of effluent between said inlet and outlet; and a first one of said clockwise and counterclockwise coils is disposed to move said mandrel away from said first one of said cross passages upon reception of said first trigger signal from said controller, said permanent magnet is disposed to hold said mandrel away from said first one of said cross passages after said mandrel is moved away from said first one of said cross passages, and a second one of said clockwise and counterclockwise coils is disposed to move said mandrel away from said permanent magnet and toward said first one of said cross passages upon reception of said second trigger signal from said controller.

11. The faucet of claim 10, wherein said bias means is disposed to urge said mandrel to travel toward a rest position where said mandrel engages said first one of said cross passages.

12. The faucet of claim 9, further comprised on a constant potential source coupled to said clockwise and counterclockwise coils, and said switching means is coupled to said clockwise and counterclockwise coils to selectively connect said constant potential source via alternate ones of said clockwise and counterclockwise coils to a ground potential.

13. The faucet of claim 10, further comprised of a constant potential source coupled to said clockwise and counterclockwise coils, and switching means disposed between said coils and controller to selectively connect said constant potential source to a ground potential via alternate ones of said clockwise and counterclockwise coils in response to reception of corresponding ones of said first and second trigger signals.

14. The faucet of claim 11, further comprised of a constant potential source coupled to said clockwise and counterclockwise coils, and switching means disposed between said coils and controller to selectively connect said constant potential source to a ground potential via alternate ones of said clockwise and counterclockwise coils in response to reception of corresponding ones of said first and second trigger signals.

* * * * *